US007537726B2

(12) United States Patent
Glätzle et al.

(10) Patent No.: US 7,537,726 B2
(45) Date of Patent: May 26, 2009

(54) METHOD OF PRODUCING A HARD METAL COMPONENT WITH A GRADUATED STRUCTURE

(75) Inventors: Johannes Glätzle, Breitenwang (AT); Rolf Kösters, Reutte (AT); Wolfgang Glätzle, Reutte (AT)

(73) Assignee: CERATIZIT Austria Gesellschaft m.b.H., Reutte (AT)

( * ) Notice: Subject to any disclaimer, the term of this patent is extended or adjusted under 35 U.S.C. 154(b) by 0 days.

(21) Appl. No.: 11/869,127

(22) Filed: Oct. 9, 2007

(65) Prior Publication Data

US 2008/0075621 A1 Mar. 27, 2008

Related U.S. Application Data

(62) Division of application No. 10/417,487, filed on Apr. 17, 2003, now abandoned.

(30) Foreign Application Priority Data

Apr. 17, 2002 (AT) ..... GM245/2002

(51) Int. Cl.
*C22C 29/02* (2006.01)
*B22F 3/00* (2006.01)

(52) U.S. Cl. ..... 419/14; 419/13; 419/15; 419/35; 419/36; 419/38

(58) Field of Classification Search ..... 419/15, 419/30, 35, 36, 13, 14, 38; 148/514
See application file for complete search history.

(56) References Cited

U.S. PATENT DOCUMENTS

| | | | |
|---|---|---|---|
| 4,101,703 | A | 7/1978 | Schintlmeister |
| 4,610,931 | A | 9/1986 | Nemeth et al. |
| 4,743,515 | A | 5/1988 | Fischer et al. |
| 4,820,482 | A | 4/1989 | Fischer et al. |
| 5,116,416 | A | 5/1992 | Knox et al. |
| 5,431,239 | A | 7/1995 | Tibbitts et al. |
| 5,453,241 | A | 9/1995 | Akerman et al. |
| 5,494,635 | A | 2/1996 | Bennett |
| 5,543,235 | A | 8/1996 | Mirchandani et al. |
| 5,594,931 | A | 1/1997 | Krall et al. |
| 5,762,843 | A | 6/1998 | Massa et al. |
| 5,856,626 | A | 1/1999 | Fischer et al. |
| 5,945,167 | A | 8/1999 | Kuwabara et al. |
| 6,027,808 | A | 2/2000 | Aoki et al. |
| 6,073,518 | A | 6/2000 | Chow et al. |
| 6,495,115 | B1 | 12/2002 | Dunmead et al. |
| 6,511,265 | B1 | 1/2003 | Mirchandani et al. |
| 6,869,460 | B1 | 3/2005 | Bennett et al. |
| 2004/0187638 | A1 | 9/2004 | Heinrich et al. |

FOREIGN PATENT DOCUMENTS

| | | | | |
|---|---|---|---|---|
| DE | 197 52 289 | C1 | | 4/1999 |
| EP | 0 111 600 | A1 | | 6/1984 |
| EP | 0 247 985 | A2 | | 12/1987 |
| EP | 0 498 781 | A1 | | 8/1992 |
| EP | 0 871 556 | B1 | | 10/1998 |
| JP | 04128330 | | * | 4/1992 |
| JP | 04187739 | A | | 7/1992 |
| WO | 00/38864 | | | 7/2000 |
| WO | 01/43899 | A1 | | 6/2001 |

* cited by examiner

*Primary Examiner*—Roy King
*Assistant Examiner*—Ngoclan T Mai
(74) *Attorney, Agent, or Firm*—Laurence A. Greenberg; Werner H. Stemer; Ralph E. Locher

(57) ABSTRACT

A component is produced by powder metallurgy from hard metal. The alloy includes at least one grain growth-inhibiting additive from the group consisting of V, Cr, Ti, Ta and Nb with, at least locally, a graduated concentration profile. As a result, the mechanical properties also have a graduated profile. In the fabrication process, a dispersion or solution which contains the grain growth-inhibiting additive in finely distributed or dissolved form is applied to the surface of a green compact. Penetration of this dispersion or solution along open pores leads to a graduated distribution of the grain growth-inhibiting additive in the green compact. There is also described a process in which the grain growth-inhibiting additive in the form of a solution is distributed uniformly in the green compact and is then gradually broken down from edge regions by a heat treatment or a solvent.

14 Claims, 3 Drawing Sheets

METHOD OF PRODUCING A HARD METAL COMPONENT WITH A GRADUATED STRUCTURE

CROSS-REFERENCE TO RELATED APPLICATIONS

This is a divisional application of application Ser. No. 10/417,487, filed Apr. 17, 2003; the application also claims the priority, under 35 U.S.C. § 119, of Austrian application AT GM 245/2002, filed Apr. 17, 2002; the prior applications are herewith incorporated by reference in their entirety.

BACKGROUND OF THE INVENTION

Field of the Invention

The invention lies in the metallurgy field. More specifically, the invention relates to a component produced by powder metallurgy from a hard metal alloy with a binder content of from 0.1 to 20% by weight which contains at least one grain growth-inhibiting additive. The invention, furthermore, pertains to a process for producing the component.

The term hard metal is understood as meaning a composite material which substantially comprises a carbidic component and a binder. The most important carbidic components include the carbides or mixed carbides of the metals W, Ti, Zr, Hf, V, Nb, Ta, Mo and Cr. Typical binder metals are Co, Ni and Fe. Additions of further hard materials, such as for example carbonitrides, are also used.

The properties of hard metals are determined by the ratio of carbide content to binder content, by the chemical composition, the carbide grain size and the carbide grain size distribution. This opens up numerous options for matching the properties of hard metal to the corresponding application area.

For example, increasing the binder content leads to an improvement in the fracture toughness and bending strength, combined, at the same time, with a reduction in the hardness, rigidity and compressive strength. A reduction in the carbide grain size leads to an increase in the hardness, the compressive strength and the bending strength combined with a reduced impact toughness and fracture toughness.

Nowadays, carbidic powders in the grain size range from 0.2 μm to 15 μm are used for the production of hard metal components according to the intended use. To reduce the grain coarsening during the sintering operation when fine-grained carbide powder is used, grain growth inhibitors are added. The most effective grain growth-inhibiting additives are vanadium carbide, chromium carbide, titanium carbide, tantalum carbide and niobium carbide. In many cases, two or more additives are used, such as for example mixtures of VC and $Cr_3C_2$ or TaC, NbC and TiC. The grain growth-inhibiting additive can be distributed extremely finely in the main component as early as before or during the carburizing step. However, it is also effective if the grain growth inhibitor is admixed with the hard metal powder or individual constituents of the hard metal powder before, during or after milling.

Hard metal components may be subject to very differing local loads. Therefore, from a very early stage solutions which are based on a material composite comprising two or more hard metal alloys have been discovered and implemented. For example, U.S. Pat. No. 5,543,235 describes a hard metal material composite which is produced by powder metallurgy composite pressing, the individual material regions differing in terms of their composition or microstructure. A rotating composite tool which is composed of two hard metal alloys is also described in U.S. Pat. No. 6,511,265 B1 and international PCT publication WO 01/43899. Production is likewise preferably effected by composite pressing.

A further process technique for the manufacture of a hard metal composite body is described in U.S. Pat. No. 5,594,931. A surface layer or slip which consists of a powder mixture, a solvent, a binder and a plasticizer is applied to a green compact or core. The composite green compact produced in this way is densified by sintering.

However, a drawback of the material composites described here is that stress concentrations occur in the regions of the composite body where materials with different properties meet one another. Furthermore, account must be taken of the fact that each material component has its own sintering characteristics. This may cause distortion to the component during sintering.

However, if the transition between two material regions is made with a graduated composition, stress peaks can be substantially avoided. A structure of graduated composition is understood to mean that the composition changes gradually and continuously over a certain region. Especially in the case of coated hard metal, graduated formations in the region of the layer, in the region of the layer/base material transition and in the adjacent base material have long been known. This graduation is achieved, for example, by the addition of carbonitrides. During the sintering, the nitrogen in the edge zone of the hard metal body is broken down. The metallic carbide-forming or nitride-forming elements diffuse toward the center of the hard metal body. This results in an increase in the levels of binder in the region of the edge zone and a graduated transition to the matrix composition. For example, disposable cutting tool tips with a binder-rich edge zone adjacent to the hard-material layer have long been in use for the machining of steel. However, the graduation is restricted to a small region close to the surface.

For high loaded components, it is advantageous to establish a structure which is graduated over a wide region. In this way, it is possible to achieve considerable improvements to the service life, specifically if the mechanical demands imposed on the hard metal differ in the edge region and the core region.

Since the usual binder metals, such as for example cobalt, have a high diffusivity at the sintering temperature, it is possible to achieve concentration compensation in the transition zone between two hard metal alloys which have a differing cobalt content by means of diffusion processes. In this way, it is possible to establish a continuous transition. A process for that purpose is described, for example, in U.S. Pat. No. 5,762,843 and European patent EP 0 871 556. A composite body which comprises at least two regions which differ in terms of their binder content is produced by composite pressing. During the sintering, the temperature is to be set in such a way that the binder metal diffuses out of the composite region with the higher binder content into the composite region with a lower binder content. A drawback of this process is that the sintering temperature has to be set very accurately in order not to produce complete concentration balancing and thereby lose the different materials properties. A further drawback is that composite pressing is associated with higher production costs than is the case when a monolithic green compact is being produced.

European patent applications EP 0 247 985 and EP 0 498 781 likewise describe hard metal bodies with a binder phase gradient and a process for producing them. In this case, first of all a sintered body with a uniformly distributed η phase is produced by means of standard process steps using a reduced-carbon starting powder mixture. A subsequent treatment in a carburizing atmosphere leads to partial dissolution of the η phase in the region of the edge zone. The level of η phase increases gradually and the binder content decreases gradually in the direction of the center of the hard metal body. However, a drawback is that the η phase has an embrittling action. Moreover, the additional carburizing step is time-consuming and energy-consuming.

European patent application EP 0 111 600 describes a highly loaded tool for rock drilling. The device comprises an inner region and an outer region, with a continuous transition of the mechanical properties between these regions. The proposed process technology is a complex powder feed making it possible to continuously adjust the powder concentration during the filling operation. A powder feed of this nature requires complex apparatus and is difficult to control in terms of process technology.

BRIEF SUMMARY OF THE INVENTION

It is accordingly an object of the invention to provide a hard metal component with a graduated structure and a manufacturing process which overcome the above-mentioned disadvantages of the heretofore-known devices and methods of this general type.

With the foregoing and other objects in view there is provided, in accordance with the invention, a method of producing a component made from a hard metal alloy, containing at least one carbide, mixed carbide or carbonitride of the metals selected from the group consisting of W, Ti, Ta, Mo, Zr, Hf, V, Nb, and Cr, at least one grain growth-inhibiting additive selected from the group consisting of V, Cr, Ti, Ta, and Nb or a compound thereof, and at least one metallic binder selected from the group consisting of Co, Ni, and Fe, the binder content being 0.1 to 20% by weight and at least one grain growth-inhibiting additive having, at least locally, a graduated concentration profile, with the carbide grain size increasing from an edge zone of the component in a direction towards a center of the component. The novel method comprises the following steps:

producing a green compact from a hard metal alloy using powder metallurgy compacting or shaping processes;

producing a dispersion or solution containing at least one grain growth-inhibiting additive selected from the group consisting of V, Cr, Ti, Ta, and Nb or a compound thereof in finely distributed or dissolved form;

applying the dispersion or solution to a surface of the green compact and targeted action to establish a concentration gradient; and subjecting the article to heat consolidation.

There is, therefore, also provided an article of manufacture made from a hard metal alloy, comprising:

at least one carbide, mixed carbide or carbonitride of the metals selected from the group consisting of W, Ti, Ta, Mo, Zr, Hf, V, Nb, Cr, and V; at least one grain growth-inhibiting additive selected from the group consisting of V, Cr, Ti, Ta, and Nb or a compound thereof, at least one of said grain growth-inhibiting additives, at least locally, having a graduated concentration profile; and at least one metallic binder selected from the group consisting of Co, Ni and Fe with a binder content of 0.1-20% by weight.

In accordance with an added feature of the invention, the hard metal alloy has a graduated grain size profile, at least locally. Also preferably, the hard metal alloy has a graduated hardness profile.

In accordance with an additional feature of the invention, the concentration of the grain growth-inhibiting additive decreases gradually from the edge zone of the component toward the center of the component. Conversely, the carbide grain size increases gradually from the edge zone of the component toward the center of the component.

In accordance with an alternative feature of the invention, the concentration of the grain growth-inhibiting additive increases gradually from the edge zone of the component toward the center of the component. Conversely, the carbide grain size decreases gradually from the edge zone of the component toward the center of the component.

In accordance with a preferred embodiment, the grain growth-inhibiting additive consists of Cr and/or V, or a compound thereof. A maximum content of the grain growth-inhibiting additive, based on the hard metal alloy, is 2% by weight, and its content decreases gradually to a value x, where $0<x<1.0\%$ by weight.

In accordance with an alternative process, the manufacture comprises the following steps:

producing a green compact from a hard metal alloy, containing at least one carbide, mixed carbide or carbonitride of the metals selected from the group consisting of W, Ti, Ta, Mo, Zr, Hf, V, Nb, Cr, and V, at least one metallic binder selected from the group consisting of Co, Ni, and Fe, an optional addition of wax or a plasticizer;

producing a solution containing at least one grain growth-inhibiting additive selected from the group of metals consisting of V, Cr, Ti, Ta, and Nb or a compound thereof;

applying the solution to a surface of the green compact, for example, by dipping, spraying, and/or brushing;

targeted action to establish the concentration gradient or complete infiltration;

gradually removing the grain growth inhibitor from regions close to the surface by heat treating and/or with a solvent; and subjecting the article to heat consolidation.

In other words, the above objects are achieved by a component made from a hard metal alloy and by a process for producing it, in which the hard metal alloy contains at least one carbide, mixed carbide or carbonitride of the metals from the group consisting of W, Ti, Ta, Mo, Zr, Hf, V, Nb, Cr and V, at least one grain growth-inhibiting additive from the group consisting of V, Cr, Ti, Ta and Nb or a compound of these metals, and at least one metallic binder from the group consisting of Co, Ni and Fe, at least one of the grain growth-inhibiting additives, at least locally, having a graduated concentration profile.

The graduated concentration profile of the grain growth-inhibiting additive leads to a graduated profile of the carbide grain size. Consequently, the mechanical properties also have a graduated profile. This is advantageous, for example, where a high wear resistance and bending fracture strength is required at the surface and, at the same time, a high toughness is required in the core, such as for example in forming tools or tools for diamond production. If the concentration profile of the gain growth-inhibiting additive is now set in such a way that the concentrations are higher in the regions of the edge zone and decrease in the direction of the center of the component, the edge zone is in fine-grain form, with a graduated transition to the more coarse-grained center. As a result, it is possible to produce components with an excellent wear resistance and bending fracture toughness in the region of the edge zone, in combination with a high toughness in the center. These components have an improved tool service life. A high fracture toughness in the region of the edge zone may also be advantageous in the event of a high cyclical or impact shock loading. This is achieved by a reduced grain growth-inhibiting additive content in the region of the edge zone. The compressive and bending strength properties in the core of the component are improved by a graduated profile of the grain size and a more fine-grained center. This embodiment is also favorable for coated components. The action of the invention is also achieved if the hard metal alloy contains further, non-carbidic hard material phases, provided that the mechanical properties are not significantly adversely affected as a result.

Advantageous grain growth-inhibiting additives worthy of mention are vanadium and chromium compounds, the maximum concentration being 2% by weight. Higher contents lead to embrittlement effects. A particularly advantageous process is the application of a dispersion or solution to the surface of a green compact. The dispersion contains the grain growth-inhibiting additive in extremely finely distributed form. The green compact may be in the as-pressed state. If the green compact contains additions of wax and/or plasticizer, it may also, according to an advantageous configuration of the present invention, be in the dewaxed or partly dewaxed state. The application of the dispersion or solution can be carried out, for example, by dipping, spraying or brushing. The dispersion or solution then penetrates into the interior of the green compact along open pores. The duration of action and the grain growth-inhibiting additive content in the dispersion or solution substantially determine the introduction quantity and the penetration depth. Therefore, depending on the profile of requirements, it is possible to set a graduation which extends only on the micrometer scale. However, it is also possible to make the graduation such that it extends all the way to the center of the component. Furthermore, the process can also be carried out in such a way that first of all the green compact is completely impregnated with the dispersion. This is then removed again from the regions close to the surface by means of suitable solvents or by thermal processes. Furthermore, the dispersion may be applied to the entire surface or alternately only to local parts of the surface. In particular the local application makes it possible to produce components or tools which only have a high hardness where resistance to wear is required. The remaining regions have a coarser microstructure with a high fracture toughness. Furthermore, it has proven advantageous if the carbidic component of the green compact has a mean grain size of less than 2 μm.

Other features which are considered as characteristic for the invention are set forth in the appended claims.

Although the invention is illustrated and described herein as embodied in a hard metal component with a graduated structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The following text describes production examples which are intended to explain the implementation of the invention by way of example. The figures relate back to the examples 1-3 of the following description.

Figure 1:
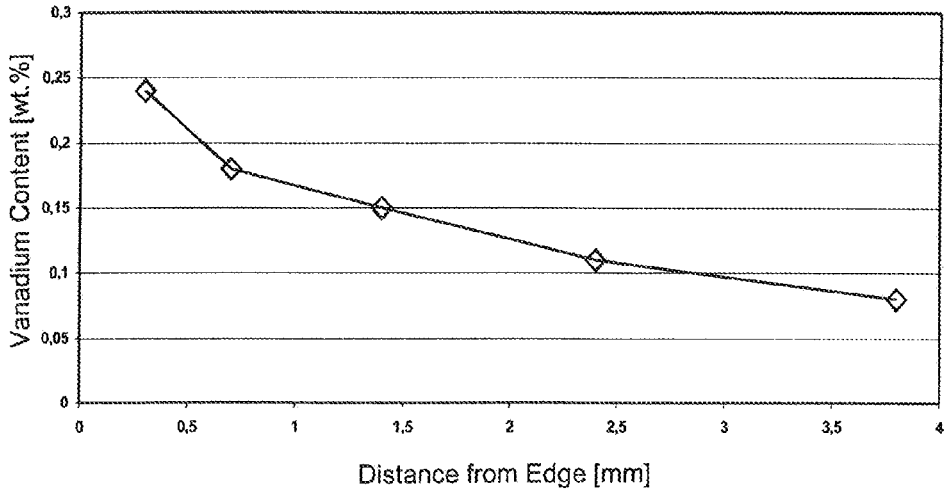
FIG. 1 is a graph showing the vanadium content over the specimen cross section in a production example according to the invention.
Figure 2:
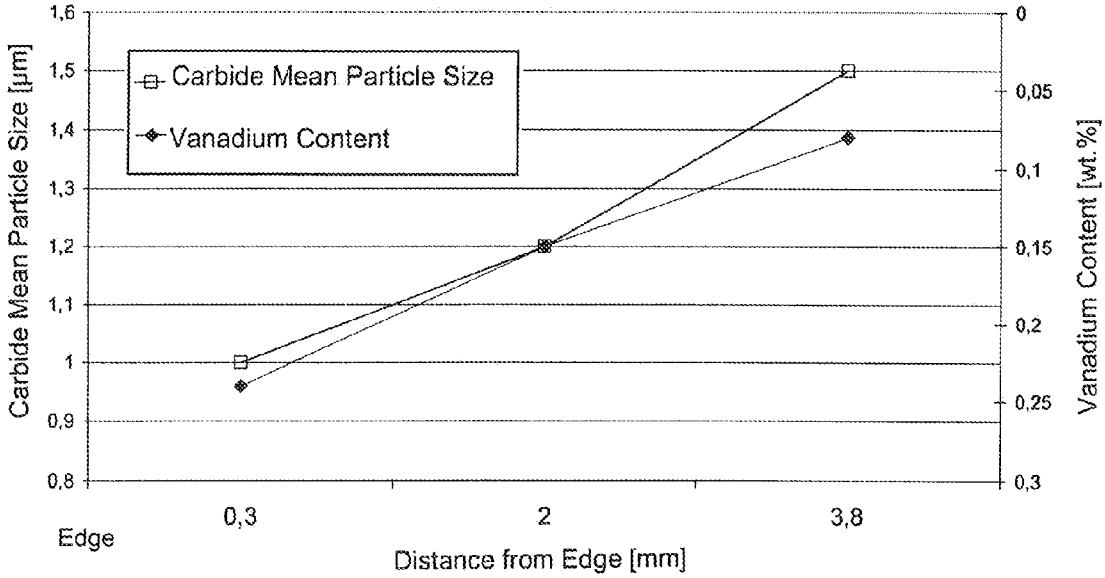
FIG. 2 is a graph showing the carbide grain size in addition to the vanadium content, plotted over the cross section.
Figure 3:
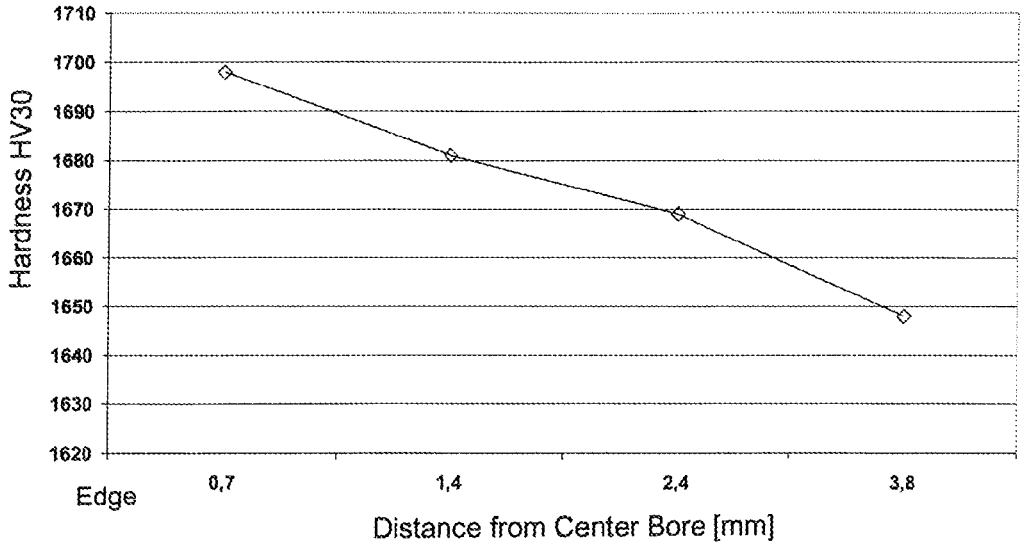
FIG. 3 is a graph showing a hardness profile over the specimen cross section.
Figure 4:
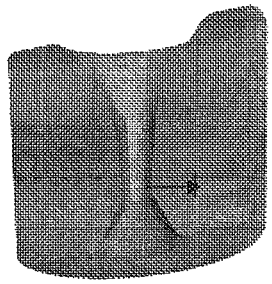
FIG. 4 is a perspective view of a cross section through a drawing tool.
Figure 5:
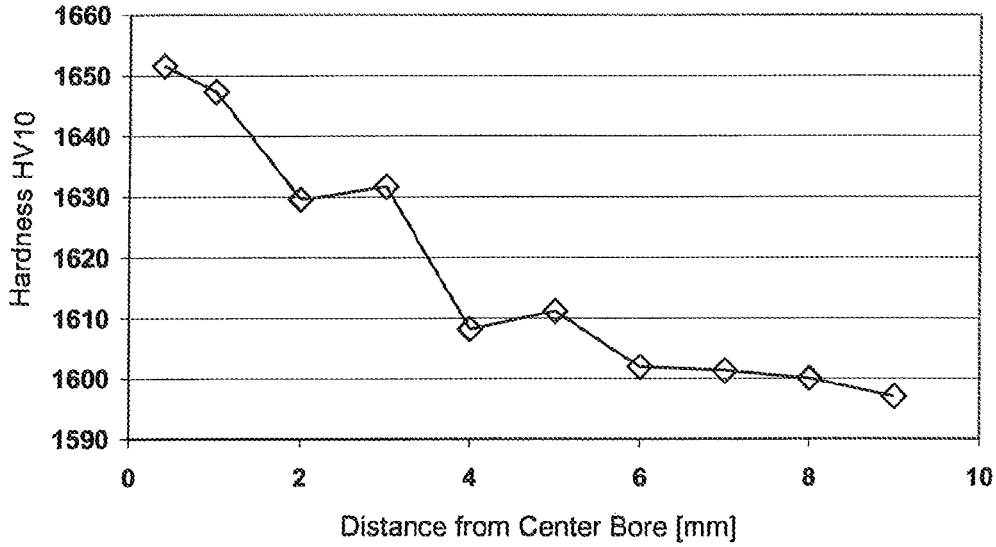
FIG. 5 is a graph showing a hardness profile over the specimen cross section.

FIG. 1 and FIG. 2 relate to example 1; FIG. 3 relates to example 2; FIG. 4 and FIG. 5 relate to example 3.

EXAMPLE 1

A hard metal batch containing 94% by weight of WC with a mean grain size of 1 μm, remainder Co, was produced using the processes which are standard in the hard metal industry. Green compacts in the shape of disposable cutting tool tips were produced by die pressing with a pressure of 50 kN. The green compacts were subjected to a standard dewaxing process. Furthermore, a dispersion of distilled water and $V_2O_5$ was prepared, with a solids content of 2% and a mean $V_2O_5$ particle size of less than 50 nm. Then, the green compacts were dipped in the above-described dispersion for 5 seconds and then dried in air at 50° C. These specimens were sintered in vacuum at a temperature of 1400° C. together with reference green compacts which had not been subjected to any further treatment. The specimens were analyzed by means of electron beam microprobe, and the microstructural and mechanical characteristics were determined by a light-microscope examination and hardness testing, in each case on microsections.

FIG. 1 shows that the vanadium content in the region of the edge zone is 0.24% by weight, and this value decreases gradually toward the inside over the cross section of the specimen. The vanadium content at a distance of 3.8 mm from the specimen edge is 0.08% by weight. In the reference specimen, the corresponding vanadium concentrations were below the detection limit of the microprobe. The graduated vanadium distribution leads to a graduated grain stabilization effect, as documented by the WC grain size values shown in FIG. 2. While the mean grain size increases from the edge zone toward the center, the corresponding hardness values decrease, as shown in FIG. 3.

EXAMPLE 2

A hard metal batch containing 89.5% by weight of WC with a mean grain size of 0.8 μm, 0.5% by weight of $Cr_3C_2$, remainder Co was produced using the processes which are standard in the hard metal industry. Green compacts in the shape of disposable cutting tool tips were produced by die pressing with a pressure of 50 kN. The green compacts were subjected to a standard dewaxing process. Furthermore, a dispersion of distilled water and $V_2O_5$ was prepared, with a solids content of 2% by weight and a mean $V_2O_5$ particle size of less than 50 nm. Then, the green compacts were dipped into the above-described dispersion for 5 seconds and then dried in air at 50° C. These specimens were sintered in vacuum at a temperature of 1400° C. together with reference green compacts which had not been subjected to any further treatment. The specimens were analyzed by means of electron beam microprobe, and the microstructural and mechanical characteristics were determined by a light-microscope examination and hardness testing.

The specimens according to the invention once again have a graduated vanadium concentration profile with an edge zone value of 0.21% by weight of V and a center value of 0.03% by weight of V. The corresponding hardness values are 1 698 HV30 and 1 648 HV30. The hardness profile is shown in FIG. 3. The reference specimen has a hardness profile which is uniform over the cross section, with a mean value of 1605 HV30. The specimens according to the invention and the reference specimens were also subjected to a bending test. The mean obtained from ten measurements is 3950 MPa for the specimens according to the invention and 3500 MPa for the comparison specimens.

EXAMPLE 3

A hard metal batch containing 93.4% by weight of WC with a mean grain size of 2.0 μm, 0.2% of TiC, 0.4% by weight of TaC/NbC, remainder Co was produced using the processes which are standard in the hard metal industry. Cylindrical green compacts were produced by isostatic pressing at a pressure of 100 MPa and were shaped into a hard metal drawing tool by machining. The green compacts were subjected to a standard dewaxing process. Once again, a dispersion of distilled water and $V_2O_5$ was produced, with a solids content of 2% by weight and a particle size of the dispersed $V_2O_5$ particles of less than 50 nm. Then, the dispersion was applied selectively in the entry and bore region. Drying once again took place at 50° C. in air. These specimens were sintered in vacuum at a temperature of 1400° C. A microsection was made by metallographic specimen preparation, as illustrated in FIG. 4.

FIG. 4 also shows the region where the characterization was performed by means of electron beam microprobe and hardness testing. The vanadium content in the edge zone is 0.18% by weight but is only 0.11% by weight at a distance of 2 mm from the edge of the specimen. FIG. 5 shows the gradual hardness profile.

The invention claimed is:

1. A method of producing a component made from a hard metal alloy, containing at least one carbide, mixed carbide or carbonitride of the metals selected from the group consisting of W, Ti, Ta, Mo, Zr, Hf, V, Nb, and Cr, at least one grain growth-inhibiting additive selected from the group consisting of V, Cr, Ti, Ta, and Nb or a compound thereof, and at least one metallic binder selected from the group consisting of Co, Ni, and Fe, the binder content being 0.1 to 20% by weight and at least one grain growth-inhibiting additive having, at least locally, a graduated concentration profile, with the carbide grain size increasing from an edge zone of the component in a direction towards a center of the component, the method which comprises the following method steps:

producing a powder preform made from a hard metal alloy using powder metallurgy compacting or shaping processes;

producing a dispersion or solution containing at least one grain growth-inhibiting additive selected from the group consisting of V, Cr, Ti, Ta, and Nb or a compound thereof in finely distributed or dissolved form;

applying the dispersion or solution to a surface of the powder preform and producing a graduated concentration profile by penetration of the dispersion or solution towards an interior of the powder preform; and further processing by heat consolidation.

2. The method according to claim 1, wherein the applying step comprises applying the dispersion or solution by dipping, spraying, or brushing.

3. The method according to claim 1, which comprises producing the component with an at least locally graduated profile of the grain size.

4. The method according to claim 1, which comprises producing a component having an at least locally graduated hardness profile.

5. The method according to claim 1, which comprises adjusting the grain growth-inhibiting additive to decrease in graduated fashion from the edge zone of the component toward the center of the component.

6. The method according to claim 1, wherein the grain growth-inhibiting additive consists of Cr and/or V or a compound thereof, and a maximum content, based on the hard metal alloy, is 2% by weight, and the maximum content decreases gradually to a value x where $0<x<1.0$ by weight.

7. The method according to claim 1, wherein the applying step comprises applying the dispersion or solution only to a partial region of the component surface.

8. The method according to claim 1, which comprises forming the powder perform with carbidic powder having a mean grain size of <2 μm.

9. The method according to claim 1, wherein the dispersion is distilled water and $V_2O_5$.

10. The method according to claim 9, which comprises forming the dispersion with $V_2O_5$ having a mean particle size smaller than 50 nm.

11. The method according to claim 1, which comprises adding a plasticizing agent to the powder preform.

12. The method according to claim 11, which comprises at least partly dewaxing the powder preform by a heat treatment step prior to applying the dispersion or solution.

13. A method of producing a component made from a hard metal alloy, containing at least one carbide, mixed carbide or carbonitride of the metals selected from the group consisting of W, Ti, Ta, Mo, Zr, Hf, V, Nb, and Cr, at least one grain growth-inhibiting additive selected from the group consisting of V, Cr, Ti, Ta, and Nb or a compound thereof, and at least one metallic binder selected from the group consisting of Co, Ni, and Fe, the binder content being 0.1 to 20% by weight and at least one grain growth-inhibiting additive having, at least locally, a graduated concentration profile, with the carbide grain size increasing from an edge zone of the component in a direction towards a center of the component, the method which comprises the following method steps:

producing a powder preform made from a hard metal alloy using powder metallurgy compacting or shaping processes;

producing a dispersion of distilled water and $V_2O_5$ in finely distributed or dissolved form;

applying the dispersion to a surface of the powder preform and targeted action to establish a concentration gradient; and further processing by heat consolidation.

14. The method according to claim 13, which comprises forming the dispersion with $V_2O_5$ having a mean particle size smaller than 50 nm.

* * * * *